United States Patent [19]

Rabinovich et al.

[11] 3,938,581

[45] Feb. 17, 1976

[54] PLANT FOR ELECTROSLAG MELTING OF HOLLOW METAL INGOTS

[76] Inventors: Volf Iudovich Rabinovich, ulitsa Gagarina, 74, kv. 27; Jury Nikolaevich Kriger, ulitsa Oktyabrskaya, 38, kv. 59, both of Chekhov, Moskovskoi oblasti; Igor Alexandrovich Svitenko, Teply stan, 5 mikroraion, korpus 61, kv. 149, Moscow; Vladimir Alexeevich Karpov, ulitsa Gagarina, 43, kv. 39, Chekhov, Moskovskoi oblasti, all of U.S.S.R.

[22] Filed: June 28, 1974

[21] Appl. No.: 484,226

[52] U.S. Cl. ..... 164/252

[51] Int. Cl.[2] ..... B22D 27/02

[58] Field of Search ..... 164/52, 252

[56] References Cited

UNITED STATES PATENTS

| | | | |
|---|---|---|---|
| 3,610,319 | 10/1971 | Kleinhagauer et al. | 164/252 |
| 3,848,657 | 11/1974 | Tetjuev et al. | 164/252 |

FOREIGN PATENTS OR APPLICATIONS

| | | | |
|---|---|---|---|
| 242,210 | 9/1969 | U.S.S.R. | 164/252 |

*Primary Examiner*—Francis S. Husar
*Assistant Examiner*—John E. Roethel
*Attorney, Agent, or Firm*—Holman & Stern

[57] ABSTRACT

A plant for melting hollow metal ingots comprising means including at least one side core to shape openings with a horizontal axis in the ingot; and a hollow consumable electrode having at least one through slot along its length, which slot has a width and length sufficient to accommodate said side core with a clearance.

10 Claims, 4 Drawing Figures

PLANT FOR ELECTROSLAG MELTING OF HOLLOW METAL INGOTS

BACKGROUND OF THE INVENTION

The present invention relates to plants and apparatus for the electroslag melting of hollow metal ingots, e.g. those similar in geometry to power fitting casings having a longitudinal space in communication with holes in connecting pipes arranged transversely to the longitudinal axis.

The present invention is aimed at providing maximum geometric similarity of an ingot and a finished article which feature making possible a decrease in production costs of shaped articles.

A method for the manufacture of hollow metal ingots by electroslag melting in a cooled outfit (means) is presently known, and which comprises a base plate mounting, a means (a mould) for shaping an external side surface of the ingot with a means (a mandrel) disposed coaxially therewith, and adapted for shaping an internal side surface of the ingot. A mandrel is introduced into an outfit melting space from either above or below.

The mandrel in adapted for introduction into the melting space from above, and is fitted with elements through which it rests on the upper end of the means (mould) for shaping the external surface of the ingot.

The above elements, disposed transversely to the longitudinal axis of the outfit, interfere with the introduction of the hollow consumable electrode into the melting space.

In this connection the hollow metal ingots may only be melted by using consumable electrodes with a solid and comparatively small cross-section so as to enable their introduction into the space between the mould and the mandrel with a clearance.

The hollow consumable electrodes are utilized in plants wherein the mandrel is introduced from below through an opening in the base plate. However, the above plants are not suitable for melting ingots which would ensure a maximum similarity in geometry to the finished articles, e.g. having conduits in connecting pipes.

The melting of hollow metal ingots with openings on their side surface would necessitate reducing the scope of their machining.

The prior art inventors believe that openings on the side surfaces of such ingots can be utilized coupled with the aid of mandrels introduced into the outfit melting space through the holes in the wall of the means for shaping the external side surface of the ingot being melted. However, the side mandrels representing the outfit elements would be disposed transversely to the direction of motion of the consumable electrode in the course of fusing thereof, and thereby hampering the introduction of the hollow consumable electrode into the melting space.

It is due to these problems that at present the casings for the fittings employed in nuclear power engineering are welded from separate stampings or forgings. All this results in a considerable increase in the cost of articles being produced. Moreover, the metal of such articles does not always features adequate strength and homogeneity.

Due to a growing demand for shaped ingots for articles utilized in different branches of industry, a need has arisen to eliminate the above difficulties, and to solve electroslag melting problems involving high-quality metal ingots, and thus ensuring maximum similarity in geometry to the finished articles, e.g. to the power fitting casings with openings in their side surface (in connecting pipes).

The known plants for electroslag melting of hollow metal ingots are not adapted for melting shaped ingots with openings on their side surface.

SUMMARY OF THE INVENTION

The principal object of the invention is to provide a plant for the electroslag melting of hollow metal ingots ensuring the production of ingots with openings on their side surface, such as the openings in the connecting pipes of power fitting casings.

Another no less important object of the invention is to provide a reduction in the cost of melting said ingots.

Still another object of the invention is to diminish the scope of machining of such ingots.

Said and other objects are achieved by providing a plant for electroslag melting of hollow metal ingots, comprising a supporting metal structure with a carriage movable vertically thereon, and carrying an electrode holder with a consumable electrode fastened thereto, an outfit means having at least a single element disposed transversely to the direction of movement of said electrode in the course of its fusing within a space bounded by a base plate, and a means mounted thereon and adapted for shaping the external side surface of the ingot, coupled with a means positioned coaxially therewith, and adapted for moulding the internal side surface of the ingot, with the plant using, according to the invention, a hollow consumable electrode having at least a single through slot directed along its length, with the slot width and length being sufficient to accommodate with a clearance for the above element of the outfit.

According to the invention, the plant furnished with the hollow consumable electrode of a new shape is adapted for melting hollow metal ingots by introducing a mandrel into the melting space from above with the electrode slots being located accordingly on the side of the outfit elements. In this case the elements holding the mandrel in place, and those moulding the openings in the side surface of the ingot, are so disposed that they are enclosed in the corresponding slots of the hollow consumable electrode.

The outfit element for shaping an opening in the side surface of the ingot can be made as a mandrel to be introduced into the melting space through an opening in the wall of the means for shaping the external side surface of the ingot being melted.

The above embodiment of the aforesaid element is most simple in terms of its design and, in spite of its transverse arrangement within the melting space, renders the process most effective due to the presence of the slots in the hollow consumable electrode.

An electroslag melting plant can be furnished with a hollow consumable electrode which is a tube provided with the above-mentioned through slots.

This is a most simple embodiment of a hollow consumable electrode, according to the invention.

The above plant may be also fitted with a hollow consumable electrode compiled of metal rods butting against one another and drawn apart (open) at the place where the above-mentioned outfit element is located.

In this case the metal rods may be utilized for producing a consumable electrode of any given diameter.

It is likewise expedient that the consumable electrode employed in the electroslag melting plants may also be composed of the metal rods having a round cross-section.

The rods with the round cross-section have found wide application, and are readily available for use as the electrodes.

It is desirable that a consumable electrode made up of metal rods having a rectangular cross-section be used in the above-described plants.

The consumable electrode manufactured from the rectangular rods is convenient for use when melting ingots having a rectangular cross-section.

According to the invention, the hereinbefore described possible embodiments of a plant for the electroslag melting of hollow metal ingots by making use of consumable electrodes, and appropriate outfits therefore, make it possible to diminish materially the cost of ingot production featuring maximum similarity in geometry to that the finished articles.

BRIEF DESCRIPTION OF THE DRAWINGS

The present invention will be better understood from a consideration of a detailed description of exemplary embodiments thereof, taken in conjunction with the accompanying drawings, wherein.

DETAILED DESCRIPTION OF THE INVENTION

Figure 1:
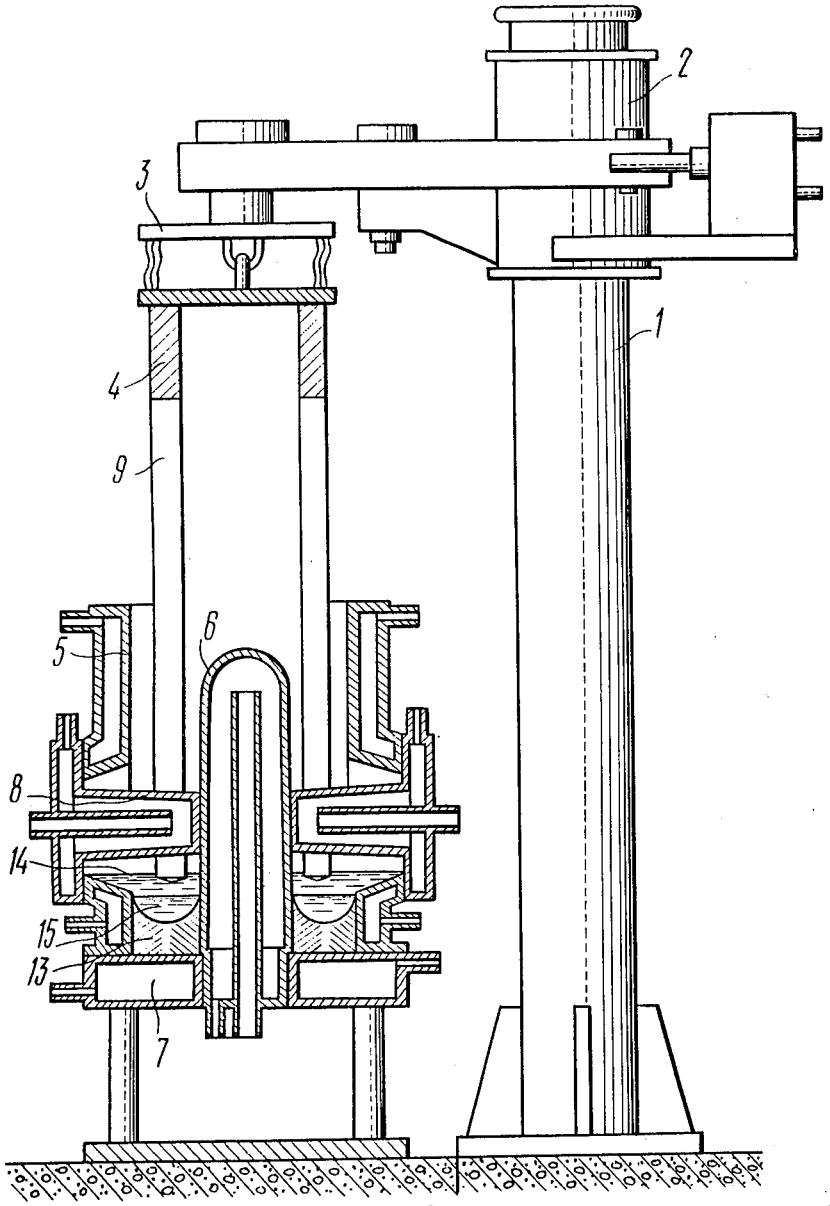
FIG. 1 shows a plant for the electroslag melting of hollow metal ingots by using mandrels and a hollow consumable electrode introduced from below and into a cooled outfit to melt the ingot (a longitudinal sectional view of the outfit, mandrels, and of the consumable electrode)

A plant for the electroslag melting of hollow metal ingots, comprising a supporting metal structure 1 (FIG. 1) with a carriage 2 movable thereon and mounting an electrode holder 3 which carries a hollow consumable electrode 4. The electroslag melting process is effected in a cooled outfit (means) having a means 5 for shaping an external ingot surface, a means 6 for shaping an internal ingot surface and a base plate 7.

Figure 2:
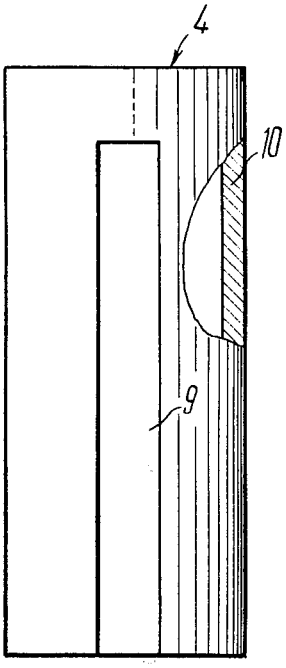
FIG. 2 is a side view with a fragmentary cutaway view of the consumable electrode on the side of a through slot.

The aforesaid outfit has side mandrel elements 8 arranged in a melting space transversely to the direction of motion of the hollow consumable electrode 4 in the course of fusing. The above hollow consumable electrode 4 (FIG. 2) has a through slot 9 directed along its length.

Figure 3:
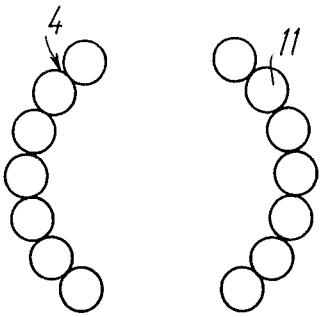
FIG. 3 is a top view of the consumable electrode made up of metal rods having a round cross-section drawn apart at the location of the two side mandrels.

The hollow consumable electrode 4 can be made as a tube 10 or compiled of metal rods 11 (FIG. 3) butting against one another and drawn apart (open) at the location of outfit elements i.e. side mandrels 8 (FIG. 1). The rods 11 (FIG. 3) may have a round cross-section, and may be positioned round the circumference.

Figure 4:
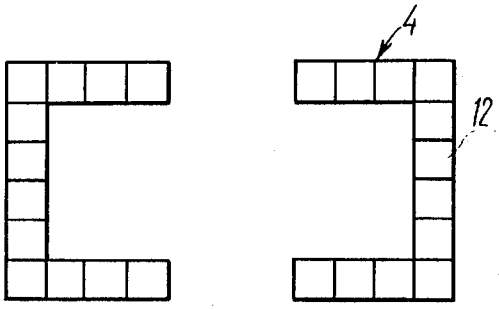
FIG. 4 is a top view of the consumable electrode compiled of metal rods having a rectangular cross-section drawn apart at the location of the two side mandrels.

For melting hollow ingots having a rectangular cross-section, it is expedient that metal rods 12 (FIG. 4) having a rectangular cross-section be used.

In this case if the consumable electrode 4 is compiled of separate metal rods 11 (FIG. 3) or 12 (FIG. 4), the latter are attached with their upper ends to the electrode holder 3.

In the herein-described exemplary embodiment the shaping means 6 is introduced through the base plate 7, but in other possible embodiment, it can be introduced from above and resting on the upper end of the means 5 with the help of members (not shown in the drawing) disposed transversely, and inserted into the slots 9 of the consumable electrode 4.

The electroslag melting of a hollow ingot 13 (FIG. 1) in the electroslag melting plant is accomplished, according to the invention, in the following manner:

The means 5 for shaping the external side surface of the ingot 13 is mounted on the base plate 7. The means 6 for shaping the internal side surface of the ingot 13, depending on its design, is introduced either from below into the outfit melting space through an opening in the base plate 7, or from above to be fixed on the upper end of the means 5. The mandrels 8 for shaping the opening in the side surface of the ingot 13 are introduced into the outfit melting space through the openings in the walls of the means 5. The mandrels 8 are introduced until the faces of their free ends come in contact with the side surface of the mandrel means 6 for shaping the space located along the longitudinal axis of the ingot 13.

Next, the hollow consumable electrode 4 is fixed in the electrode holder 3 which in turn is held by the carriage 2. Following that the hollow consumable electrode 4 is introduced into the melting space between the means 5 and means 6 by shifting the carriage 2 along the metal structure so that additional outfit elements—the mandrels 8 are placed with a clearance within the electrode slots 9. After that a slag bath 14 is established in the melting space, and an electric current is passed through the hollow consumable electrode 4, and the base plate 7. During the passage of the electric current through the slag bath 14, heat is evolved therein with the hollow consumable electrode 4 melting off under the effect of this heat and thus forming a metal pool 15 crystallizing into the ingot 13 upon cooling.

As the lower section of the consumable electrode 4 dipped into the slag bath 14 melts off, the electrode 4 is lowered by shifting the carriage 2 along the metal structure 1. In this case the hollow consumable electrode 4 does not come in contact with the mandrels 8, insofar as the above electrode 4 is provided with the through slots 9 directed longitudinally along its axis. The length and width of said slots 9 ensures the displacement of the hollow consumable electrode 4 with the proper clearance, as it melts off, and in relation to the mandrels 8.

Where the hollow consumable electrodes 4 employed in the plant are compiled of rods having a round 11 or rectangular 12 cross-section, the electroslag process of melting the ingot 13 is effected in a similar way.

When the herein-proposed plant for the electroslag melting of hollow metal ingots, using the above-described apparatus and the hollow consumable electrodes, was tested, an ingot was produced for a power fitting casing fitted with openings (conduits) in connecting pipes, with the diameter of each conduit being equal to 160 mm, and the length of the conduit 150 mm.

What we claim is:

1. A plant for electroslag melting of hollow metal ingots, comprising: a supporting structure; a carriage mounted on said supporting structure movably in the vertical direction; an electrode holder fastened on said carriage; means for casting a hollow metal ingot including a base plate, a mold arranged on said base plate, and a core secured on said mold; at least one side core for shaping a cavity opening to the external side surface of the ingot, said core being inserted through the mold; a hollow consumable electrode having at least one through slot along its length, which slot having a width and length sufficient to accommodate said side core with a clearance.

2. The plant for electroslag melting of hollow metal ingots as claimed in claim 1, wherein said hollow consumable electrode is a tube provided with said through slot.

3. The plant for electroslag melting of hollow metal ingots as claimed in claim 1, wherein said hollow consumable electrode is made up of metal rods butting against one another and drawn apart at the point where said side core is located.

4. The plant for electroslag melting of hollow metal ingots as claimed in claim 3, wherein each of said metal rods has a round cross-section.

5. The plant for electroslag melting of hollow metal ingots as claimed in claim 3, wherein each of said metal rods has a rectangular cross-section.

6. A plant for electroslag melting of hollow metal ingots comprising: a supporting structure; a carriage mounted on said supporting structure movably in the vertical direction; an electrode holder attached on said carriage; means for casting a hollow metal ingot including a base plate, a mold and a core, all located on said base plate; at least one side core for shaping a cavity opening to the external side surface of the ingot, said side core being inserted through the mold; a hollow consumable electrode having at least one through slot along its length and having a width sufficient to accommodate said side core with a clearance.

7. The plant for electroslag melting of hollow metal ingots as claimed in claim 6, wherein said hollow consumable electrode is a tube provided with said through slot.

8. The plant for electroslag melting of hollow metal ingots as claimed in claim 6, wherein said hollow consumable electrode is made up of metal rods butting against one another and drawn apart at the point where said side core is located.

9. The plant for electroslag melting of hollow metal ingots as claimed in claim 8, wherein each of said metal rods has a round cross-section.

10. The plant for electroslag melting of hollow metal ingots as claimed in claim 8, wherein each of said metal rods has a rectangular cross-section.

* * * * *